US005965084A

United States Patent [19]

Nishijima

[11] Patent Number: 5,965,084

[45] Date of Patent: Oct. 12, 1999

[54] PROCESS FOR PRODUCING NON-WOVEN FABRICS OF ULTRAFINE POLYOLEFIN FIBERS

[75] Inventor: Masaru Nishijima, Moriyama, Japan

[73] Assignee: Chisso Corporation, Osaka, Japan

[21] Appl. No.: 09/053,203

[22] Filed: Apr. 1, 1998

Related U.S. Application Data

[63] Continuation-in-part of application No. 08/741,192, Oct. 29, 1996, abandoned.

[51] Int. Cl.[6] ..... D01D 5/32; D01F 8/06; D04H 3/10

[52] U.S. Cl. ..... 264/557; 264/103; 264/143; 264/147; 264/168; 264/172.14; 264/210.8; 264/211.15

[58] Field of Search ..... 264/103, 143, 264/147, 168, 172.14, 210.8, 211.15, 557

[56] References Cited

U.S. PATENT DOCUMENTS 5,759,926 6/1998 Pike et al. ..... 264/557 X

FOREIGN PATENT DOCUMENTS 4-289209 10/1992 Japan ..... 264/557

*Primary Examiner*—Leo B. Tentoni

*Attorney, Agent, or Firm*—Fay, Sharpe, Beall, Fagan, Minnich & McKee

[57] ABSTRACT

A process for producing a non-woven fabric of ultrafine polyolefin fibers by subjecting a web of splittable conjugate polyolefin fibers to a water needle processing, and non-woven fabric thus obtained are described. The polyolefin composite fibers, contain 1.0 to 7.0% by weight of a hydrophilic component blended therein. The non-woven fabrics include ultrafine fibers having a size of 0.5 denier or less and a non-circular cross-section. Splitting and peeling off of the conjugate fibers and generation of static electricity with the composite fibers at a carding step is suppressed. The non-woven fabrics have an excellent wiping property, softness, and hydrophilic property.

2 Claims, 1 Drawing Sheet

PROCESS FOR PRODUCING NON-WOVEN FABRICS OF ULTRAFINE POLYOLEFIN FIBERS

This is a continuation-in-part of application Ser. No. 08/741,192 filed on Oct. 29, 1996, now abandoned.

BACKGROUND OF THE INVENTION

1. Field of the Invention

The present invention relates to a process for producing a non-woven fabric of ultrafine polyolefin fibers by subjecting a web of splittable conjugate polyolefin fibers to a water needle processing, and non-woven fabrics having a good hydrophilic property, softness, and wiping property, and being obtained from the splittable composite fibers.

2. Description of the Related Art

Recently, woven or non-woven fabrics comprising ultrafine fibers are widely used from the aspect of their excellent softness, hand feeling, and wiping property, and their high strength. As the methods for producing the woven or non-woven fabrics, a method is generally performed in which multi-core type composite fibers, so called "sea-island type composite fibers", produced from two or more kinds of resins having a different solubility are converted into a fabric through a process for weaving, and then the sea component is removed to form a woven fabric of ultrafine fibers (Japanese Patent Publication No. Sho 43-7411). Alternatively, a method is conducted in which composite fibers, so-called "splittable composite fibers", in which two or more components having a low solubility to each other are adhered are converted into a web by a dry or wet method, and then subjected to a process for splitting and entangling of fibers with a mechanical impact such as one with a jet of high pressure water streams to obtain a non-woven fabric of ultrafine fibers (Japanese Patent Publication No. Sho 48-28005, Laid-open WO Japanese Patent Publication No. Hei 5-321018, and Japanese Patent Publication No. Hei 6-63129).

However, the method employing sea-island type composite fibers has such a problem that the method needs a step for weaving and a step for dissolving a component of the composite fibers, and thus the steps for producing a fabric becomes complicate as a whole.

On the other hand, according to the method employing splittable composite fibers, a non-woven fabric of ultrafine fibers is readily obtained, related to the method mentioned above, by subjecting the web obtained, for example, by a carding process to splitting and entanglement of fibers at the same time with high pressure water streams. However, the resins which form the splittable composite fibers must be readily splitted by a mechanical impact (or shock) and thus they are selected from the different kind of resins having a low solubility to each other. For example, a couple of resins selected from the group of polyamides, polyesters, and polyolefins are preferably used. Accordingly, splitting occurs in the midst of steps when webs are formed through steps including a carding step in a dry method.

General synthetic fibers are usually applied with a surface active agent on their surface for the purpose of suppressing generation of static electricity during processing steps. However, as the splitting mentioned above progresses, the surface area of the fibers increases and static electricity is generated, leading to a considerable deterioration of card passability of the fibers. When a fiber finishing agent was additionally applied at a carding step to suppress generation of static electricity, such problems as contamination of carding machines and lowering of web strength occur.

With conventional splittable composite fibers, a hydrophilic surface active agent which had been applied on the fiber surface as fiber finishing agent is rapidly washed away with high pressure water streams at a step for forming a non-woven fabric. On the other hand, polyolefin resin represented by polyethylene is extremely high in hydrophobic property such that its official water regain is 0%. Thus, the fibers from polyolefin avoid water stream at an initial stage of step using high pressure water streams for forming non-woven fabrics, and thus the fibers can not uniformly receive the impact energy with water. Accordingly, non-woven fabrics of ultrafine fibers splitted uniformly to a sufficient extent can not be obtained unless the number of steps using the high pressure water streams is increased.

SUMMARY OF THE INVENTION

An object of the present invention is to provide a non-woven fabric of ultrafine polyolefin fibers, preventing splitting of the conjugate fibers from occurring at a carding step and at the same time suppressing generation of static electricity with splittable composite fibers to form a uniform web, which is then subjected to a water needle processing.

As a result of diligent research and development by the present inventors, it has been found that the object mentioned above can be solved by providing at least two different kind of polyolefin resins, at least one of which comprises from 1.0% to 7.0% by weight of a hydrophilic component selected from the group consisting of a fatty acid glyceride, alkoxylated alkyl phenol, and polyoxyalkylene fatty and ester;

composite spinning two different kind of polyolefins through a spinneret for splittable composite fibers to obtain splittable composite fibers;

stretching said composite fibers;

subjecting said stretched composite fibers to crimp with a crimper;

cutting the crimped fibers to obtain staple fibers;

carding said staple fibers to from a web;

subjecting said web to water needle processing at a water pressure of 60 kg/cm$^2$ or more to obtain a non-woven fabric.

The present invention is concerned with splittable polyolefin composite fibers composed of polyolefin resins in which at least one of the resins contains 1.0 to 7.0% by weight of a hydrophilic component blended therein.

Also, the present invention is concerned with non-woven fabrics comprising ultrafine fibers which have a size of 0.5 denier or less and a non-circular cross-section, and are obtained by splitting the splittable polyolefin composite fibers mentioned above.

DESCRIPTION OF THE PREFERRED EMBODIMENTS

Figure 1:
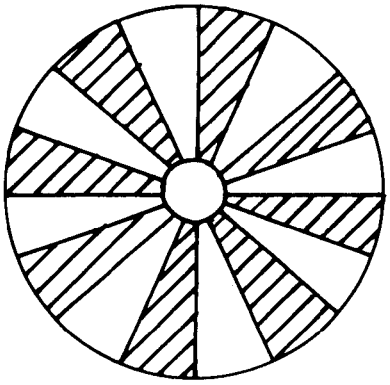
FIGS. 1 to 5 are cross-sectional views of splittable composite fibers of the present invention in which the portions where oblique lines are drawn indicate a first component and blank portions indicate a second component. Center portion in FIG. 4 indicates the hollow portion in the composite fibers.
Figure 2:
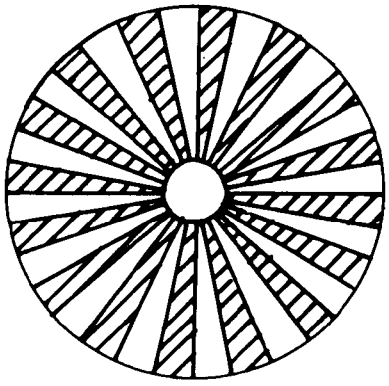
Figure 3:
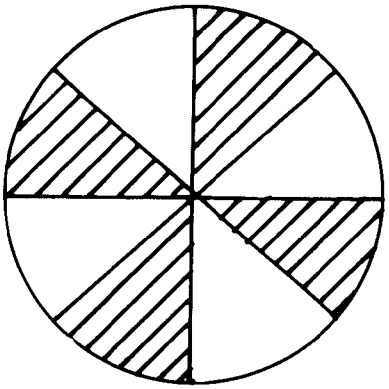
Figure 4:
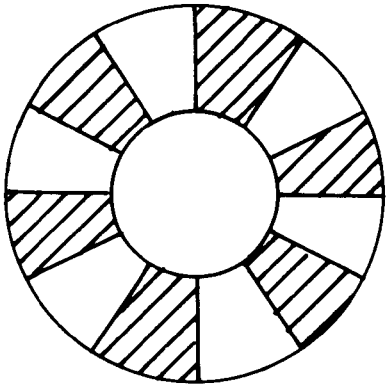
Figure 5:
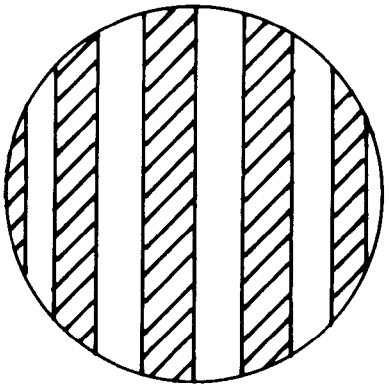

In the splittable polyolefin composite fibers of the present invention, the hydrophilic component to be used is selected from the group consisting of a fatty acid glyceride, alkoxylated alkylphenol, and polyoxyalkylene fatty acid ester.

Polyolefin resins used in the present invention include a homopolymer of ethylene or propylene, a copolymer of ethylene or propylene with other α-olefin, and their mixture. As the α-olefin copolymer, a binary or ternary copolymer containing propylene unit as main component can be used. As specific examples of these copolymers, copolymers of propylene with ethylene, butene-1, or 4-methyl pentene, each containing the propylene unit as main component can be mentioned.

A combination of a polyolefin resin and a polyester resin or polyamide resin is not suitable, because splitting or peeling off of the composite fibers occurs in a carding step. As the polyolefin resins have a relatively good miscibility with each other as compared with the combination of the different kind of resins, they do not cause splitting easily at the carding step.

Splittable composite fibers of the present invention can be obtained by composite spinning at least two polyolefin resins at least one of which contains a hydrophilic component blended therein, in radiation, parallel, or side by side relationship as shown in FIGS. 1 to 5.

In the present composite fibers, additives which impart other functional properties to the composite fibers may be blended in the range that the purpose of the present invention can be achieved. Particular additive may be selected in conform to the end uses and blended in a suitable amount.

Filamentary denier of the splittable composite fibers of the present invention is preferably 0.5 to 6.0 and more desirably 1.0 to 4.0. When the filamentary denier of the splittable composite fibers prior to the splitting is less than 0.5 denier, occurrence of neps when a web is formed at a carding step at the time of producing a non-woven fabric, and the sink of the fibers on a cylinder tend to take place.

On the other hand, when the filamentary denier exceeds 6.0, size of the splitted fibers is too large, and the wiping property of non-woven fabrics becomes unpreferably poor.

Size of splitted ultrafine fibers is preferably 0.02 to 0.50 denier. The size is more desirably 0.02 to 0.30 denier to obtain non-woven fabrics of excellent wiping property and softness.

As briefly described above, the hydrophilic component used in the present invention can suitably be selected from nonionic surface active agents such as fatty acid glycerides, alkoxylated alkylphenols, polyxyalkylene fatty acid esters, and fatty acid amides, and may be used alone or in combination. Among the compounds, the compounds expressed by the following general formulas can be mentioned as the examples of preferable hydrophilic components evaluated based on the heat stability at the time of spinning and capability of imparting hydrophilic property to polyolefin resins:

$$CH_2(OR_1)CH(OR_2)CH_2(OR_3) \quad (I)$$

wherein $OR_1$, $OR_2$ and $OR_3$ independently represent hydroxy group or a fatty acid ester group, provided that at least one of them is a fatty acid ester group.

$$R—Ph—O—(CH_2CH_2O)_n—CH_2CH_2OH \quad (II)$$

wherein R represents an alkyl group having 1 to 20 carbon atoms, Ph represents phenyl group, and n is an integer of 10 to 55.

$$R—(CH_2CH_2O)_n—CH_2CH_2OH \quad (III)$$

wherein R represents a saturated or unsaturated fatty acid ester group, and n is an integer of 10 to 55.

While the splittable polyolefin composite fibers of the present invention have a hydrophilic component blended in at least one of the polyolefin resins, the hydrophilic component may be blended in all of the resins.

Amount of the hydrophilic component to be blended to achieve the purpose of the present invention is 1.0 to 7.0% by weight and desirably 2.0 to 6.0% by weight in particular in a resin. When the amount is less than 1.0% by weight, a sufficiently advantageous effect can not be obtained since static electricity is unpreferably generated when fiber surface area increased by the peeling off or splitting during a carding step and. When the amount exceeds 7.0% by weight, spinnability at a melt spinning step unpreferably becomes poor.

Ratio of a first component in which the hydrophilic component is blended to a second component containing no hydrophilic resin is preferably 5 to 5. However, it is not particularly restricted to that ratio, and the ratio of the first component is preferably 10 to 90% by weight, and more desirably 30 to 70% by weight in the splittable composite fibers.

Non-woven fabrics of the present invention are composed of ultrafine fibers having a denier of 0.5 or less and a non-circular cross-section. The non-woven fabrics can be obtained by converting splittable composite fibers into a web using, for example, an opening machine or a carding machine, and then subjecting the web to a water needle processing. A water needle processing is described in "Spunlace Technology Today" pp 7–14 and 94 to 100, published by Miller Freeman publications (1989). The present non-woven fabrics preferably have a basis weight of 20 to 200 $g/m^2$ and more preferably 40 to 150 $g/m^2$. When the basis weight largely departs from the range mentioned above, it unpreferably results in insufficient strength and unevenness of non-woven fabrics, and insufficient splitting of the composite fibers. Non-woven fabrics of the present invention may be a mixture of the present composite fibers with another type of polyolefin fibers provided that the mixed non-woven fabrics can satisfactorily be applied in the end uses of the non-woven fabrics of the present invention.

The present composite fibers are splitted with high pressure water streams by the water needle processing. From the aspect of an object of the present invention, the splitting ratio is preferably 80% or higher. Particularly, from the aspects of softness and wiping property of the non-woven fabrics, the splitting ratio is preferably 85% or higher.

Conditions of the splitted fibers and the splitting ratio are controlled by the pressure of high pressure water streams, production line speed, number of the steps using water streams, and distance between a jet nozzle and a web. Accordingly, in order to obtain a splitting ratio of 80% or higher, water pressure is preferably 60 $kg/cm^2$ or higher and more desirably 80 $kg/cm^2$ or higher.

Since a hydrophilic component is blended in fibers themselves in the present non-woven fabrics which comprise ultrafine fibers of 0.5 denier or less and a non-circular cross-section, it is not necessary to conduct an after-treatment for making the fabrics hydrophilic, such as a treatment for adhering a hydrophilic component on the fiber surface, even in the end use where hydrophilic property is finally required. Also, when the fiber forming resins are entirely composed of polyolefin resins, the non-woven fabrics have wider general uses since a polyolefin resin is excellent in acid resistance and alkali resistance.

Based on the specific structure mentioned above, the non-woven fabrics of ultrafine fibers of the present invention can be used, for example, for wiping cloths for medical or industrial applications, masks, operating gowns, wrapping cloths, filters, surface materials of sanitary articles, reinforcing fibers for building structure, and membrane or film for liquid transportation.

EXAMPLE

Now, the present invention will be described in more detail with reference to Examples and Comparative Examples. However, it should be understood that the present invention is by no means restricted by such specific Examples, unless it deviates from the spirit of the present invention.

In each of the Examples and Comparative Examples, evaluation of physical properties of fibers and performance of non-woven fabrics are conducted by the methods mentioned below:

(1) Strength and elongation of fiber: Determination is conducted according to the method of JIS L 1069. Specifically, determination is conducted under the conditions of sample fiber length of 20 mm and stretching rate of 20 mm/min to obtain strength (g/d) and elongation (%).

(2) Card passability: Card passability of fibers was evaluated by the observation through naked eyes and the results are graded as follows:

○: Good (No static electricity was generated and no neps occurred).

x: Poor (Static electricity was generated and passing conditions were bad.)

(3) Splitting ratio: Sample fibers are embedded with a wax, and cut with a microtome at almost right angle to the fiber axis to obtain a sample piece. The sample piece is observed through a microscope, the image of the cross-section of the fibers is subjected to an image processing, the total area of the cross-section of splitted ultrafine fibers (A) and the total area of the cross-section of unsplitted splittable composite fibers (B) are determined, and the splitting ratio is calculated by the following equation:

$$\text{Splitting ratio } (\%) = A/(A+B) \times 100$$

(4) Hand feeling: Hand feeling of non-woven fabrics was evaluated through the feeling with hand, and graded as follows:

○: Very good x: Slightly bad (5) Hydrophilic property: Sample non-woven fabric of ultrafine fibers is allowed to stand in a constant temperature apparatus at 80±5° C. for 5 hours, and cooled in a desiccator down to room temperature. Then, distilled water adjusted in a constant temperature water tank at 23±2° C. was dropped through a pipet from the height of 1 cm above the non-woven fabric, with the position where water is dropped being shifted one drop by one drop so that 20 drops in total are dropped. Hydrophilic property is calculated by the following equation:

$$\text{Hydrophilic property } \% = [\text{Number of drops absorbed within 30 seconds after the dropping/number of total drops (20)}] \times 100$$

(6) Wiping property: Certain amount of fat and oil, and distilled water are applied on the flat surface of a glass plate, respectively, and a wiping test is conducted by using a sample non-woven fabric. After wiping, the blur on the surface of the glass plate is observed through naked eyes to evaluate the wiping property of the non-woven fabric, and the results are graded as follows:

| | |
|---|---|
| ○ | Good (Fat and oil, and water were clearly wiped off.) |
| X | Poor (Either the fat and oil, or water on the surface of the glass plate remained unwiped off and the blur on the surface of the glass plate was not taken away.) |

(7) Denier: Denier of the fibers prior to the splitting was determined by cutting a bundle of the fibers prior to the splitting to 6 cm, weigh the weight of 150 cut fibers, calculates the denier, and assumes the average value of the results of 5 repeated tests as the denier prior to the splitting.

Denier after the splitting is theoretically obtained from the number of divided orifices in a spinneret and the filamentary denier of the fiber prior to the splitting.

Results of the determination of the physical properties of fibers and the performance of non-woven fabrics are shown in Table 1.

Example 1

Polypropylene having a MFR (melt flow rate) of 30 g/10 min at 230° C. as the first component and a mixed resin as the second component prepared by mixing a high density polyethylene having a MFR of 25 g/10 min at 190° C. with a mixture of an ethoxylated alkylphenol and 1% by weight of a mixed glyceride (trade name: ATMER-685, produced by ICI) were extruded through a spinneret for splittable composite fibers to form splittable composite fibers having such a cross-section as shown in FIG. 1 in which the volume ratio of the first component to the second component is 5 to 5.

Splittable composite fibers thus formed were stretched at a stretching ratio of 6.0 times, subjected to a crimping treatment with a crimper to impart about 17 crimps/inch, applied with potassium salt of an alkyl phosphate as fiber finishing agent in an amount of 0.3% by weight, and then cut. Thus, staple fibers having a filamentary denier of 2.0, fiber length of 45 mm, strength of 4.2 g/d, and elongation of 38% were obtained.

Staple fibers thus obtained were formed into a web at a carding step, and subjected to a water needle processing for producing a non-woven fabric with high pressure water streams of 80 kg/cm$^2$.

Results of the evaluation on processing conditions and performances of the non-woven fabric thus obtained are shown in Table 1.

Example 2

Polypropylene having a MFR 30 g/10 min at 230° C. as the first component and a mixed resin as the second component prepared by mixing a low density linear polyethylene having a MFR of 20 g/10 min at 190° C. with 2% by weight of the same hydrophilic component as added in Example 1 were extruded through a spinneret for splittable composite fibers to form splittable composite fibers having such a cross-section as shown in FIG. 1 in which the volume ratio of the first component to the second component is 5 to 5.

Splittable composite fibers thus formed were stretched at a stretching ratio of 4.0 times, subjected to a crimping treatment with a crimper to impart about 17 crimps/inch, applied with potassium salt of an alkyl phosphate as fiber finishing agent in an amount of 0.3% by weight, and then cut. Thus, staple fibers having a filamentary denier of 1.3, fiber length of 45 mm, strength of 3.5 g/d, and elongation of 38% were obtained.

Staple fibers thus obtained were formed into a web at a carding step, and subjecting to a water needle processing for producing a non-woven fabric with high pressure water streams of 80 kg/cm$^2$.

Results of the evaluation on processing conditions and performances of the non-woven fabric thus obtained are shown in Table 1.

Example 3

Polypropylene having a MFR of 30 g/10 min at 230° C. as the first component and a mixed resin as the second component prepared by mixing a high density polyethylene having a MFR of 25 g/10 min at 190° C. with 6% by weight of the same hydrophilic component added in Example 1 were extruded through a spinneret for splittable composite fibers to form splittable composite fibers having such a cross-section as shown in FIG. 1 in which the volume ratio of the first component to the second component is 5 to 5.

Splittable composite fibers thus formed were stretched at a stretching ratio of 6.0 times, subjected to a crimping treatment with a crimper to impart about 17 crimps/inch, applied with potassium salt of an alkyl phosphate as fiber finishing agent in an amount of 0.3% by weight, and then cut. Thus, staple fibers having a filamentary denier of 2.0, fiber length of 45 mm, strength of 3.8 g/d, and elongation of 45% were obtained.

Staple fibers thus obtained were formed into a web at a carding step, and subjected to a water needle processing for producing a non-woven fabric with high pressure water streams of 80 kg/cm$^2$.

Results of the evaluation on processing conditions and performance of the non-woven fabric thus obtained are shown in Table 1.

Example 4

Polypropylene having a MFR of 30 g/10 min at 230° C. as the first component and a mixed resin as the second component prepared by mixing a high density polyethylene having a MFR of 25 g/10 min at 190° C. with 6% by weight of the same hydrophilic component as added in Example 1 were extruded through a spinneret for splittable composite fibers to form splittable composite fibers having such a cross-section as shown in FIG. 1 in which the volume ratio of the first component to the second component is 5 to 5.

Splittable composite fibers thus formed were stretched at a stretching ratio of 6.0 times, subjected to a crimping treatment with a crimper to impart about 17 crimps/inch, applied with potassium salt of an alkyl phosphate as fiber finishing agent in an amount of 0.3% by weight, and then cut. Thus, staple fibers having a filamentary denier of 6.0, fiber length of 51 mm, strength of 3.5 g/d, and elongation of 55% were obtained.

Staple fibers thus obtained were formed into a web at a carding step, and subjected to a water needle processing for producing a non-woven fabric with high pressure water streams of 80 kg/cm$^2$.

Results of the evaluation on processing conditions and performances of the non-woven fabric thus obtained are shown in Table 1.

Example 5

Polypropylene having a MFR of 30 g/10 min at 230° C. as the first component and a mixed resin as the second component prepared by mixing a high density polyethylene having a MFR of 25 g/10 min at 190° C. with 7% by weight of the same hydrophilic component added in Example 1 were extruded through a spinneret for splittable composite fibers to form splittable composite fibers having such a cross-section as shown in FIG. 1 in which the volume ratio of the first component to the second component is 5 to 5.

Splittable composite fibers thus formed were stretched at a stretching ratio of 6 times, subjected to a crimping treatment with a crimper to impart about 17 crimps/inch, applied with potassium salt of an alkyl phosphate as fiber finishing agent in an amount of 0.3% by weight, and then cut. Thus, staple fibers having a filamentary denier of 2.0, fiber length of 45 mm, strength of 3.6 g/d, and elongation of 32% were obtained.

Staple fibers thus obtained were formed into a web at a carding step, and subjected to a water needle processing for producing a non-woven fabric with high pressure water streams of 80 kg/cm$^2$.

Results of the evaluation on processing conditions and performances of the non-woven fabric thus obtained are shown in Table 1.

Example 6

Mixed resin prepared by mixing a polypropylene having a MFR of 30 g/10 min at 230° C. with 3% by weight of the same hydrophilic component as added in Example 1 as the first component and a mixed resin as the second component prepared by mixing a high density polyethylene having a MFR of 25 g/10 min at 190° C. with 3% by weight of the same hydrophilic component as added in Example 1 were extruded through a spinneret for splittable composite fibers to form splittable composite fibers having such a cross-section as shown in FIG. 1 in which the volume ratio of the first component to the second component is 5 to 5.

Splittable composite fibers thus formed were stretched at a stretching ratio of 5.0 times, subjected to a crimping treatment with a crimper to impart about 17 crimps/inch, applied with potassium salt of an alkyl phosphate as fiber finishing agent in an amount of 0.3% by weight, and then cut. Thus, staple fibers having a filamentary denier of 2.0, fiber length of 51 mm. strength of 3.5 g/d, and elongation of 45% were obtained.

Staple fibers thus obtained were formed into a web at a carding step, and subjected to a water needle processing for producing a non-woven fabric with high pressure water streams of 80 kg/cm$^2$.

Results of the evaluation on processing conditions and performances of the non-woven fabric thus obtained are shown in Table 1.

Examples 7 and 8

Non-woven fabrics were produced by the same procedures as in Example 3 with the exception that the web was processed in two steps or three steps with water streams at a pressure of 80 kg/cm$^2$.

Results of the evaluation on processing conditions and performances of the non-woven fabric thus obtained are shown in Table 1.

Comparative Example 1

Polypropylene having a MFR of 30 g/10 min at 230° C. as the first component and a high density polyethylene having a MFR of 25 g/10 min at 190° C. as the second component were extruded through a spinneret for splittable composite fibers to form splittable composite fibers having such a cross-section as shown in FIG. 1 in which the volume ratio of the first component to the second component is 5 to 5.

Splittable composite fibers thus formed were stretched at a stretching ratio of 6.0 times, subjected to a crimping treatment with a crimper to impart about 17 crimps/inch, applied with potassium salt of an alkyl phosphate as fiber finishing agent in an amount of 0.3% by weight, and then cut. Thus, staple fibers having a filamentary denier of 2.0, fiber length of 51 mm, strength of 4.3 g/d, and elongation of 30% were obtained.

Staple fibers thus obtained were formed into a web at a carding step, and subjected to a water needle processing for producing a non-woven fabric with high pressure water streams of 80 kg/cm$^2$.

Results of the evaluation on processing conditions and performances of the non-woven fabric thus obtained are shown in Table 1.

Comparative Example 2

Polypropylene having a MFR of 30 g/10 min at 230° C. as the first component and a mixed resin prepared by mixing a high density polyethylene having a MFR of 25 g/10 min at 190° C. with 0.5% by weight of the same hydrophilic component as added in Example 1 as the second component were extruded through a spinneret for splittable composite fibers to form splittable composite fibers having such a cross-section as shown in FIG. 1 in which the volume ratio of the first component to the second component is 5 to 5.

Splittable composite fibers thus formed were stretched at a stretching ratio of 6.0 times, subjected to a crimping treatment with a crimper to impart about 17 crimps/inch, applied with potassium salt of an alkyl phosphate as fiber finishing agent in an amount of 0.3% by weight, and then cut. Thus, staple fibers having a filamentary denier of 2.0, fiber length of 45 mm, strength of 4.0 g/d, and elongation of 32% were obtained.

Staple fibers thus obtained were formed into a web at a carding step, and subjected to a water needle processing for producing a non-woven fabric with high pressure water streams of 80 kg/cm$^2$.

Results of the evaluation on processing conditions and performances of the non-woven fabric thus obtained are shown in Table 1.

Comparative Example 3

Polypropylene having a MFR 30 g/10 min at 230° C. as the first component and a mixed resin as the second component prepared by mixing a high density polyethylene having a MFR of 25 g/10 min at 190° C. with 9% by weight of the same hydrophilic component as added in Example 1 were extruded through a spinneret for splittable composite fibers to form splittable composite fibers. However, filament drawing was unstable such that sample fibers were unable to obtain.

Comparative Example 4

Polypropylene having a MFR of 10 g/10 min at 230° C. as the first component and a mixed resin prepared by mixing a high density polyethylene having a MFR of 25 g/10 min at 190° C. with 6% by weight of the hydrophilic component as added in Example 1 were extruded through a spinneret for sheath-core type composite fibers to form sheath-core type composite fibers in which the volume ratio of the first component to the second component is 5 to 5.

The composite fibers thus formed were stretched at a stretching ratio of 4.0 times, subjected to a crimping treatment with a crimper to impart about 17 crimps/inch, applied with potassium salt of an alkyl phosphate as fiber finishing agent in an amount of 0.3% by weight, and then cut. Thus, staple fibers having a filamentary denier of 2.0, fiber length of 45 mm, strength of 3.2 g/d, and elongation of 77% were obtained.

Staple fibers thus obtained were formed into a web at a carding step, and subjected to a water needle processing for producing a non-woven fabric with high pressure water streams of 80 kg/cm$^2$.

Results of the evaluation on processing conditions and performances of the non-woven fabric thus obtained are shown in Table 1.

Comparative Example 5

Comparative Example 1 was repeated with the exception that the processing with water streams of a pressure of 80 kg/cm$^2$ was conducted at two steps.

Results of the evaluation on processing conditions and performances of the non-woven fabric thus obtained are shown in Table 1.

Comparative Example 6

Polyhexamethylene adipamide (nylon 66) having a relative viscosity of 2.57 in conc. sulfuric acid at 25° C. as the first component and a resin prepared by mixing polyethylene terephthalate having an intrinsic viscosity of 0.64 with 1% by weight of the same hydrophilic component added in Example 1 as the second component were extruded through a spinneret for splittable composite as used in Example 1, to obtain splittable composite fibers, followed by subjecting to the same process as described in Example, except that the composite fibers were stretched at a stretching ratio of 2.5, to obtain staple fibers.

The staple fibers were subjected to a carding process to form into a web. But no uniform web could be obtained, since card passability of the staple fibers was very bad and splitting and peeling off of the conjugate fibers occurred during the carding step. Accordingly a uniform non-woven fabric could not be obtained, even if the web were subjected to a water needle processing.

TABLE 1

| Sample | Hydrophilic component*1 | Basis weight*2 (g/m$^2$) | Pressure of processing water*3 | Splitting ratio (%) | Denier before splitting |
|---|---|---|---|---|---|
| Example 1 | PE 1 | 60 | 80 × 4 | 90 | 2.0 |
| Example 2 | PE 2 | 60 | 80 × 4 | 90 | 1.3 |
| Example 3 | PE 6 | 60 | 80 × 4 | 95 | 2.0 |
| Example 4 | PE 6 | 60 | 80 × 4 | 98 | 6.0 |
| Example 5 | PE 7 | 60 | 80 × 4 | 93 | 2.0 |
| Example 6 | PE 3 PP 3 | 60 | 80 × 4 | 90 | 2.0 |
| Example 7 | PE 6 | 60 | 80 × 2 | 80 | 2.0 |
| Example 8 | PE 6 | 60 | 80 × 3 | 88 | 2.0 |
| Comparative Example 1 | — | 60 | 80 × 6 | 75 | 2.0 |
| Comparative Example 2 | PE 0.5 | 60 | 80 × 4 | 70 | 2.0 |
| Comparative Example 3 | PE 9*4 | — | — | — | 2.0 |
| Comparative Example 4 | PE 6 | 60 | 80 × 4 | — | 2.0 |

TABLE 1-continued

| | | | | | |
|---|---|---|---|---|---|
| Comparative Example 5 | — | 60 | 80 × 2 | 62 | 2.0 |

| Sample | Denier after splitting | Card passability | Hand feeling | Wiping property | Hydrophilic property |
|---|---|---|---|---|---|
| Example 1 | 0.12 | ○ | ○ | ○ | 80 |
| Example 2 | 0.08 | ○ | ○ | ○ | 85 |
| Example 3 | 0.12 | ○ | ○ | ○ | 100 |
| Example 4 | 0.35 | ○ | ○ | ○ | 100 |
| Example 5 | 0.12 | ○ | ○ | ○ | 100 |
| Example 6 | 0.12 | ○ | ○ | ○ | 100 |
| Example 7 | 0.12 | ○ | ○ | ○ | 100 |
| Example 8 | 0.12 | ○ | ○ | ○ | 100 |
| Comparative Example 1 | 0.12 | x | ○ | x | 0 |
| Comparative Example 2 | 0.12 | ○ | ○ | x | 25 |
| Comparative Example 3 | — | — | — | — | — |
| Comparative Example 4 | — | ○ | x | x | 100 |
| Comparative Example 5 | 0.12 | x | ○ | x | 0 |

Note:
*1: Amount of hydrophilic component to be added (% by weight) to PE and PP
*2: Basis weight of non-woven fabric
*3: Pressure (kg/cm$^2$) of water used for processing × number of processing steps
*4: Sample was unable to obtain due to poor filament spinnability.

Splittable composite fibers of the present invention caused few splitting or peeling off during a card processing and showed a good card processability, because the present composite fibers are made of polyolefins having a good miscibility, and a hydrophilic component was blended therein and thus the fibers maintained a hydrophilic effect.

As the present composite fibers does not cause splitting or peeling off during the card processing, and generation of static electricity was suppressed, neps did not occur, and an improved card passability was exhibited by bleeding the hydrophilic component out of the resin.

The present composite fibers contain a hydrophilic component blended in fibers themselves; and the hydrophilic component appeared on their surface even when a hydrophilic surface active agent which was once applied on their surface as fiber finishing agent was washed away.

The present composite fibers did not repel water, did not become bulky, but maintained a wettable surface condition even in the water needle processing with high pressure water streams, since the fibers keep a hydrophilic effect. Thus, splitting ratio at a processing with high pressure water streams was considerably improved.

With the present composite fibers, a hydrophilic component appears on the surfaces which were formed by splitting. Thus, wettability of the fibers increased, and the fibers did not avoid water even a processing with water to form a non-woven fabric was repeated, and uniformly received impact energy with water. Accordingly, non-woven fabrics of ultrafine fibers splitted uniformly to a sufficient extent were obtained with a small number of processing step.

Non-woven fabrics of the present invention comprising ultrafine fibers were small in the number of unsplitted fibers contained therein. Ultrafine fibers were uniformly dispersed and entangled with each other in the non-woven fabrics. Further, the non-woven fabrics were soft and had a hydrophilic property since a hydrophilic component was blended in the fibers.

Since the present non-woven fabrics comprise ultrafine polyolefin fibers containing a hydrophilic component blended therein and having a non-circular cross-section, the fabrics exhibited a good wiping property against the blot with fat and oil as well as the blot with impurities in water.

What is claimed:

1. A process for producing a non-woven fabric which comprises the following steps of:

providing at least two different kinds of polyolefin resins, at least one of which comprises from 1.0% to 7.0% by weight of a hydrophilic component selected from the group consisting of a fatty acid glyceride, alkoxylated alkyl phenol, and polyoxyalkylene fatty acid ester;

composite spinning said two different kinds of polyolefins through a spinneret for splittable composite fibers to obtain splittable composite fibers;

stretching said composite fibers;

subjecting said stretched composite fibers to crimp with a crimper;

cutting the crimped fibers to obtain staple fibers;

carding said staple fibers to form a web; and, subjecting said web to water needle processing at a water pressure of 60 kg/cm$^2$ or more to obtain a non-woven fabric.

2. A process for producing non-woven fabric according to claim 1, wherein said two different kinds of polyolefin resins are polyethylene and polypropylene.

* * * * *